US011905978B2

(12) United States Patent
Kintea et al.

(10) Patent No.: US 11,905,978 B2
(45) Date of Patent: Feb. 20, 2024

(54) JET PUMP

(71) Applicant: NORMA Germany GmbH, Maintal (DE)

(72) Inventors: Daniel Kintea, Maintal (DE); Lukasz Gabrys, Sławniów (PL); Christian Kahl, Maintal (DE); Gerrit von Breitenbach, Maintal (DE); Michal Sajdak, Sławniów (PL)

(73) Assignee: Norma Germany GmbH, Maintal (DE)

( * ) Notice: Subject to any disclaimer, the term of this patent is extended or adjusted under 35 U.S.C. 154(b) by 0 days.

(21) Appl. No.: 17/602,442

(22) PCT Filed: Mar. 30, 2020

(86) PCT No.: PCT/EP2020/058994
§ 371 (c)(1),
(2) Date: Oct. 8, 2021

(87) PCT Pub. No.: WO2020/207847
PCT Pub. Date: Oct. 15, 2020

(65) Prior Publication Data

US 2022/0213904 A1 Jul. 7, 2022

(30) Foreign Application Priority Data

Apr. 8, 2019 (DE) ..... 10 2019 109 195.0

(51) Int. Cl.
*F04F 5/46* (2006.01)

(52) U.S. Cl.
CPC ..... *F04F 5/465* (2013.01)

(58) Field of Classification Search
CPC ..... F04F 5/00–5/54; F02K 9/46; F02K 9/50; F02K 9/97; F02K 1/36
(Continued)

(56) References Cited

U.S. PATENT DOCUMENTS 4,909,914 A 3/1990 Chiba et al.
4,957,061 A 9/1990 Ando et al.
(Continued)

FOREIGN PATENT DOCUMENTS

CN 101098759 A 1/2008
DE 578900 C 6/1933
(Continued)

OTHER PUBLICATIONS

English Translation of JP2008138686(A), captured from Espacenet on Oct. 25, 2023 (Year: 2023).*
(Continued)

*Primary Examiner* — Bryan M Lettman
(74) *Attorney, Agent, or Firm* — REISING ETHINGTON, P.C.

(57) ABSTRACT

A jet pump comprising a jet nozzle for accelerating a propellant. The jet nozzle has a convergent inlet part and an outlet part connected to the convergent inlet part. The outlet comprises an inner wall diverging at an opening angle. The opening angle is designed such that a propellant flowing through the outlet part at subsonic speed is detached from the inner wall and a propellant flowing through the outlet part at supersonic speed is guided by the inner wall. An automatic, cost-effective and simple changeover of the jet pump to different pressure ratios is hence provided.

9 Claims, 2 Drawing Sheets

(58) Field of Classification Search
USPC ..... 417/76–84, 151–198
See application file for complete search history.

(56) References Cited

U.S. PATENT DOCUMENTS

| | | | | |
|---|---|---|---|---|
| 5,240,384 | A * | 8/1993 | Tuzson | B01F 31/81 417/196 |
| 5,820,353 | A * | 10/1998 | Beylich | F04F 5/46 417/198 |
| 6,877,960 | B1 * | 4/2005 | Presz, Jr. | F04F 5/46 417/183 |
| 2005/0258149 | A1 | 11/2005 | Glukhoy et al. | |
| 2007/0295833 | A1 | 12/2007 | Oda et al. | |
| 2008/0105315 | A1 * | 5/2008 | Botros | F04F 5/467 137/814 |
| 2013/0149471 | A1 | 6/2013 | Kim | |
| 2015/0023809 | A1 * | 1/2015 | Yamada | F04F 5/463 137/833 |

FOREIGN PATENT DOCUMENTS

| | | | |
|---|---|---|---|
| DE | 3610295 | C2 | 3/1996 |
| GB | 1190409 | A | 5/1970 |
| JP | H10502426 | A | 3/1998 |
| JP | 2006212624 | A | 8/2006 |
| JP | 2008138686 | A | 6/2008 |
| KR | 20100031163 | A | 3/2010 |
| WO | WO0023757 | A1 | 4/2000 |

OTHER PUBLICATIONS

Chinese Office Action for Chinese Application No. 202080024006.6 dated Sep. 13, 2022 (6 pages).
German Office Action for German Application No. 10 2019 109 195.0 dated Feb. 6, 2020 (6 pages).
International Search Report for International Application No. PCT/EP2020/058994 dated Jul. 9, 2020 (4 pages).
English Translation of International Search Report for International Application No. PCT/EP2020/058994 dated Jul. 9, 2020 (3 pages).
Chinese Office Action for Chinese Application No. 202080024006.6 dated Feb. 11, 2023 (6 pages).
Korean Office Action for Korean Application No. 10-2021-7034865 dated Mar. 18, 2023 (4 pages).
English Translation of Korean Office Action for Korean Application No. 10-2021-7034865 dated Mar. 18, 2023 (4 pages).
Japanese Office Action for Japanese Application No. 2021-559445 dated Apr. 25, 2023 (4 pages).
English Translation of Japanese Office Action for Japanese Application No. 2021-559445 dated Apr. 25, 2023 (6 pages).
Third Chinese Office Action for Chinese Application No. 202080024006.6 dated Sep. 8, 2023 (4 pages).
Japanese Office Action for Japanese Application No. 2021-559445 dated Oct. 10, 2023 (3 pages).
English Translation of Japanese Office Action for Japanese Application No. 2021-559445 dated Oct. 10, 2023 (5 pages).
Korean Office Action for Korean Application No. 10-2021-7034865 dated Sep. 26, 2023 (3 pages).
English Translation of Korean Office Action for Korean Application No. 10-2021-7034865 dated Sep. 26, 2023 (2 pages).

* cited by examiner

JET PUMP

INTRODUCTION

The disclosure relates to a jet pump with a jet nozzle for accelerating a propellant.

Jet pumps use a fluid jet comprising a propellant in order to draw in and accelerate a suction medium. The suction action is brought about by the propellant flowing past the suction medium, wherein the suction medium is also carried by the propellant when the flow speed of the propellant is sufficiently high. In order to accelerate a propellant, it is guided under pressure through a nozzle, which accelerates the propellant. If the suction pressure and the propellant pressure have a subcritical pressure relationship, a convergent nozzle is used to accelerate the propellant in the jet pump. In the event of supercritical pressure relationships, a convergent/divergent nozzle, a so-called Laval nozzle, is used in order to further accelerate the propellant which has been accelerated to the speed of sound in the convergent portion of the Laval nozzle. A Laval nozzle, with propellants which flow at subsonic speed, leads to a deceleration of the flow speed since the divergent portion of the Laval Nozzle acts as a diffusor for the propellant.

SUMMARY

An object of the disclosure, according to an embodiment, is to provide an improved jet pump which enables an operation at sub-critical and supercritical pressure relationships.

The disclosure relates to a jet pump comprising a jet nozzle for accelerating a propellant, wherein the jet nozzle has a convergent inlet portion and an outlet portion which is connected to the convergent inlet portion, wherein the outlet portion comprises an inner space which is surrounded by an inner wall and which diverges at an opening angle, wherein there is provision according to an embodiment of the disclosure for the opening angle to be constructed in such a manner that a propellant which flows through the outlet portion at subsonic speed is released from the inner wall and a propellant which flows through the outlet portion at supersonic speed is guided by the inner wall.

The disclosure, according to an embodiment, provides for a jet pump having a jet nozzle whose convergent inlet portion accelerates a propellant which flows through the convergent inlet portion, wherein the propellant flows at subsonic speed before flowing through the inlet portion. If the propellant after flowing through the inlet portion and the acceleration then continues to have subsonic speed, it also flows through the outlet portion at subsonic speed. The outlet portion of the jet nozzle has in this instance a divergent inner wall, that is to say, the cross section of the outlet portion increases from the convergent inlet portion. The jet nozzle may in this instance be a specially constructed Laval nozzle. The opening angle of the divergent inner wall is in this instance so large that a propellant flowing at subsonic speed through the outlet portion is released from the inner wall of the outlet portion. The outlet portion of the jet nozzle consequently does not act for the propellant which is flowing at subsonic speed as a diffusor so that no deceleration of the speed of the propellant is brought about when flowing through the outlet portion. Instead, only the convergent inlet portion of the jet nozzle acts on the propellant flowing at subsonic speed. The jet nozzle acts on the propellant which flows at subsonic speed as a convergent nozzle. If the propellant is accelerated by the convergent inlet portion to the speed of sound, it is further accelerated by the divergent inner space of the outlet portion. The propellant is in this instance guided by the divergent inner wall of the outlet portion since it is not released from the inner wall in this instance. In this instance, the outlet portion acts as a nozzle for the propellant which is flowing at supersonic speed and further accelerates the propellant. Consequently, the jet nozzle acts as a Laval nozzle for propellant which is flowing at supersonic speed.

The disclosure, according to an embodiment, consequently provides for a jet pump which, both under subcritical pressure conditions, that is to say, when the propellant at subsonic speed brings about the suction action, and under supercritical pressure conditions, that is to say, when the propellant at supersonic speed brings about the suction action, is operated with a single jet nozzle. The action of the outlet portion on the flowing propellant is in this instance automatically adjusted by the opening angle of the inner wall. As a result of the disclosure, according to an embodiment, therefore, an automatic, cost-effective and simple switching of the jet pump to different pressure relationships is provided.

The inner wall of the outlet portion may be constructed in such a manner that the propellant flowing through the outlet portion is released from the inner wall during a transition from supersonic speed to subsonic speed. In other words, the inner wall of the outlet portion may be constructed in such a manner that propellant flowing through the outlet portion is released from the inner wall during a transition from a supercritical pressure relationship to a subcritical pressure relationship.

Consequently, the pressure during operation of the jet pump can be changed from the supercritical pressure relationship to the subcritical pressure relationship, wherein pressure shocks are prevented during the switching operation. This brings about an additional expansion of the range of application of the jet pump.

Furthermore, the inner wall of the outlet portion may be constructed in such a manner that the propellant flowing through the outlet portion during a transition from subsonic speed to supersonic speed is positioned against the inner wall and is guided by the inner wall. In other words, the inner wall of the outlet portion may be constructed in such a manner that the propellant flowing through the outlet portion during a transition from the subcritical pressure relationship to the supercritical pressure relationship is positioned against the inner wall and is guided by the inner wall.

Consequently, a frictionless transition from the subcritical pressure relationship to the supercritical pressure relationship may be carried out. This further expands the range of application of the jet pump.

Furthermore, a pressure relationship of a propellant pressure of the propellant to a suction pressure at the outlet portion may be between 1.05 and 5, preferably between 1.1 and 2.5.

Consequently, the jet pump may be operated in a broad pressure range, wherein the pressure relationships in comparison with a desired suction pressure may be subcritical or supercritical.

Consequently, both at a low pressure relationship, in which the propellant flows at subsonic speed, and with a high pressure relationship, in which the propellant flows at supersonic speed, an adequate suction pressure for the operation of the jet pump is provided.

The jet pump consequently has a subcritical and a supercritical operating range in which it can be operated. Consequently, the jet pump can be operated in a wide range of applications.

Advantageously, per an embodiment, the opening angle is more than 7°.

With opening angles of more than 7°, the release of the propellant which is flowing through the outlet portion at subsonic speed from the inner wall is further promoted. Consequently, an adhesion of the propellant flowing through the outlet portion to the inner wall of the outlet portion at subsonic speeds is prevented.

BRIEF DESCRIPTION OF THE FIGURES

Other features, details and advantages of the disclosure will be appreciated from the wording of the claims and from the following description of embodiments with reference to the drawings, in which:

DETAILED DESCRIPTION

Figure 1:
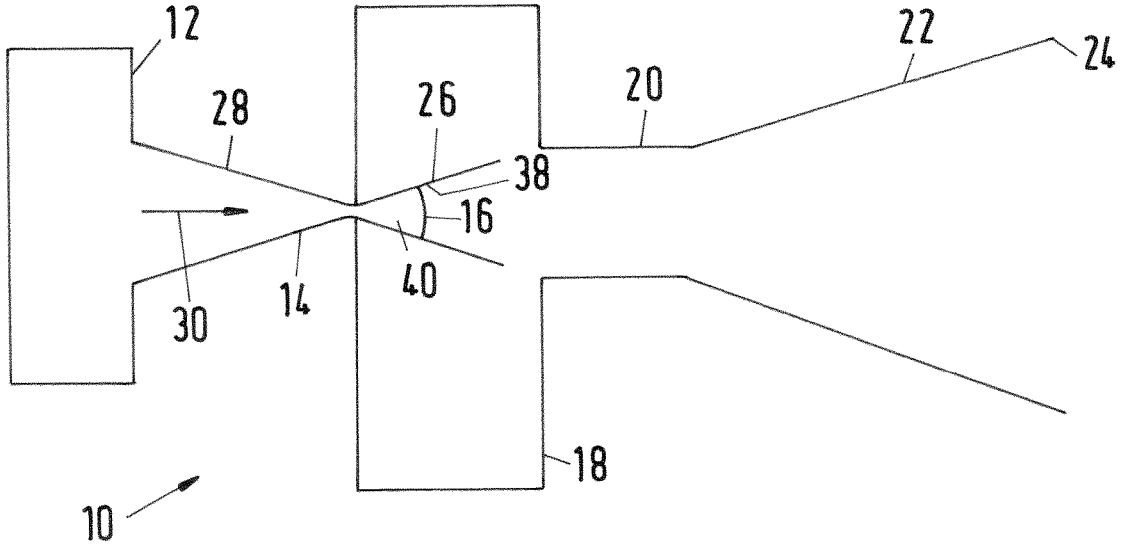
FIG. 1 is a schematic illustration of the jet pump.

FIG. 1 is a schematic sectioned illustration of a jet pump, wherein the jet pump is designated 10 in its entirety. The jet pump 10 has a propellant tank 12, a jet nozzle 14, a suction medium tank 18, a mixing chamber 20 and a diffusor 22.

The propellant is provided in the propellant tank 12. The propellant may be a compressible propellant in this instance. The propellant may be acted on in the propellant tank 12 with a pressure or be stored under pressure in the propellant tank 12. The pressure relationship may, for example, be between 1.05 and 5, preferably between 1.1 and 2.5. Under this propellant pressure, the propellant flows during operation of the jet pump 10 from the propellant tank 12 to the jet nozzle 14. This is illustrated by the arrow 30.

The propellant nozzle 14 has in this instance a convergent inlet portion 28 and an outlet portion 26 having a divergent inner space 40. The outlet portion 26 and the convergent inlet portion 28 are connected to each other. The connection location of the convergent inlet portion 28 with the outlet portion 26 has the smallest cross section of the jet nozzle 14.

The convergent inlet portion 28 has a cross section which tapers. The propellant flows initially into a region of the convergent inlet portion 28 with a large cross section. As a result of the tapering of the cross section of the convergent inlet portion 28, the propellant flowing through the convergent inlet portion 28 is accelerated.

Depending on the propellant pressure, the propellant is accelerated by the convergent inlet portion 28 to a subsonic speed or the speed of sound when the propellant flows through the convergent inlet portion 28.

Figure 3A:
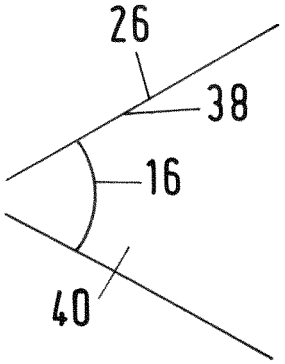
FIGS. 3*a, b* are schematic illustrations of examples of the outlet portion.
Figure 3B:
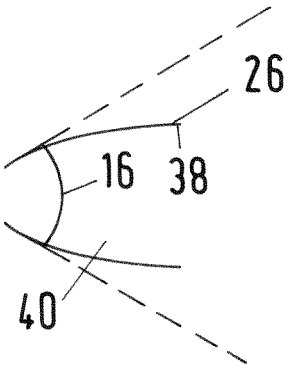

The outlet portion 26 adjoins the tapered end of the convergent inlet portion 28. In this instance, the outlet portion 26 comprises an inner wall 38 which laterally surrounds the inner space 40. In this case, the inner wall 38 may in one embodiment surround the inner space 40 in the form of a conical covering face, as illustrated in FIG. 3*a*. In another embodiment, the inner wall 38 may surround the inner space 40 in the form of a covering face having a bell-like shape, as illustrated in FIG. 3*b*.

The inner space 40 has in this instance an inlet opening which is connected to the outlet opening of the convergent inlet portion 28. Furthermore, the inner space 40 has an outlet opening which is larger than the inlet opening of the inner space 40. The inner wall 38 extends between the inlet opening and the outlet opening of the inner space 40. The inner space 40 is in this instance constructed in a divergent manner and diverges at an opening angle 16. The inner wall 38 defines the opening angle 16 directly in accordance with the narrowest cross section at the inlet opening of the inner space 40. The opening angle 16 of the inner wall 38 may in this instance change with increasing spacing from the inlet opening.

The opening angle 16 is in this instance selected in such a manner that a propellant flowing through the outlet portion 26 at subsonic speed is released from the inner wall 38 and a propellant flowing through the outlet portion 26 at supersonic speed is guided by the inner wall 38. That is to say, the inner wall 38 does not influence a propellant flowing through the outlet portion 26 at sub-sonic speed. Instead, the propellant which flows at subsonic speed is released from the inner wall 38 and flows as a jet from the outlet opening of the convergent inlet portion 28 through the outlet portion 26 and out of the jet nozzle 14.

The opening angle 16 is further selected in such a manner that a propellant flowing through the outlet portion 26 at supersonic speed is guided by the inner wall 38. An expansion, carried out perpendicularly to the flow direction, of the propellant flowing through the outlet portion 26 is in this instance limited by the inner wall 38. An outer region of the flow of the propellant therefore flows along the inner wall 38.

In this instance, the opening angle 16 may be at least 7°. An upper limit of the opening angle 16 may, for example, be between 8° and 45°.

As a result of the expansion which is carried out perpendicularly to the flow direction and which is limited by the inner wall 38, the propellant is further accelerated and flows at an increased supersonic speed from the outlet portion 26.

After leaving the outlet portion 26, the propellant flows past an opening of the suction medium tank 18 and brings about a suction pressure.

The suction medium is also carried and accelerated by the propellant flowing past the suction medium tank 18. The propellant and the suction medium thereby reach the mixing chamber 20. Whilst the propellant and the suction medium flow through the mixing chamber 20, the propellant and the suction medium are mixed.

The mixing chamber 20 is adjoined by a diffusor 22 in which the propellant and the suction medium which is mixed therewith are decelerated. The diffusor 22 comprises an outlet opening 24. The propellant and the suction medium can flow out of the jet pump through the outlet opening 24.

Figure 2A:
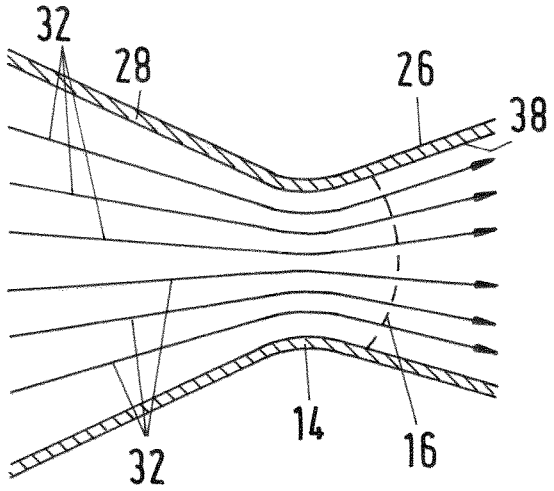
FIGS. 2*a, b* are schematic illustrations of the jet nozzle.
Figure 2B:
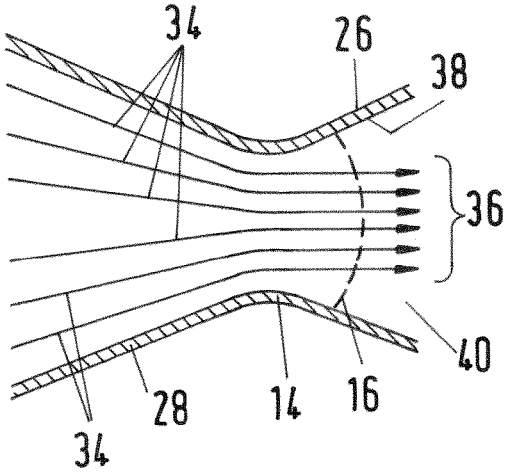

FIGS. 2*a* and 2*b* are a schematic cross section through the jet nozzle 14, wherein the flow of the propellant through the jet nozzle 14 is indicated by means of flow lines 32, 34.

In this instance, the propellant in FIG. 2*a* is accelerated to the speed of sound by means of the convergent inlet portion 28. In the convergent inlet portion 28, this is indicated by the merging flow lines 32. From the convergent inlet portion 28, the propellant which has been accelerated to the speed of sound flows into the outlet portion 26. In the outlet portion 26, the flow lines 32 diverge from each other. The outer flow lines 32 extend in this instance along the inner wall 38, whereby it is indicated that the propellant is guided along the inner wall 38 through the inner space 40. The propellant is in this instance expanded and the speed is consequently further increased to supersonic speed.

In FIG. 2*b*, the propellant is also accelerated by means of the convergent inlet portion 28 but the speed of the propellant remains below the speed of sound. The propellant therefore flows at subsonic speed out of the convergent inlet portion 28. The flow lines 34 are compressed in the convergent inlet portion 28.

Since the opening angle 16 of the divergent inner wall 38 is selected in such a manner that a propellant flowing at subsonic speed is released from the divergent inner wall 38, the propellant is not expanded in the outlet portion 26, but instead flows as a free jet through the outlet portion 26. This is illustrated by the flow lines 34 in the outlet portion 26, which extend substantially parallel with each other. The free jet has in the outlet portion 26 an almost constant width 36.

The width 36 of the subsonic flow of the propellant in the outlet portion 26 is therefore smaller than a clear width of the inner space 40 which is laterally delimited by the inner wall 38, wherein the clear width increases as a result of the divergent inner wall 38.

Consequently, the inner wall 38 is prevented from acting as a diffusor for the propellant flowing at subsonic speed and the propellant is braked by the outlet portion 26.

The pressure of the propellant in the convergent inlet portion 28 can be increased or decreased during operation. The inner wall 38 of the outlet portion 26 is in this instance constructed in such a manner that the propellant flowing through the outlet portion 26 during a transition from the supercritical pressure relationship to the subcritical pressure relationship is released from the inner wall 38. Conversely, the propellant flowing through the outlet portion 26 during a transition from a subcritical pressure relationship to a supercritical pressure relationship will be positioned against the inner wall 38 and be guided by the inner wall 38.

This means that the speed of the propellant in the outlet portion 26 can change between supersonic speed and subsonic speed without there being any disruption to the operation of the jet pump 10. The jet pump 10 can consequently be operated both at a supercritical pressure relationship and at a subcritical pressure relationship.

In this instance, at a suction pressure of 0.98 bar and a propellant pressure of 1.1 bar, a subcritical pressure relationship can be adjusted at which the propellant flows through the outlet portion 26 at a subsonic speed, wherein the flowing propellant is released from the inner wall 38.

At a suction pressure of 0.98 bar and a propellant pressure of 2.5 bar, a supercritical pressure relationship at which the propellant flows at supersonic speed through the outlet portion 26 can consequently be adjusted, wherein the flowing propellant is guided by the inner wall 38.

The invention is not limited to one of the embodiments described above but can instead be modified in a variety of ways.

All of the features and advantages derived from the claims, the description and the drawings, including structural details, spatial arrangements and method steps, may be inventively significant both individually and in extremely varied combinations.

All the features and advantages, including structural details, spatial arrangements and method steps, which follow from the claims, the description and the drawing can be fundamental to the invention both on their own and in different combinations. It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

10 Jet pump
12 Propellant tank
14 Jet nozzle
16 Opening angle
18 Suction medium tank
20 Mixing chamber
22 Diffusor
24 Outlet opening
26 Outlet portion
28 Convergent inlet portion
30 Flow direction
32 Supersonic flow lines
34 Subsonic flow lines
36 Width of free jet
38 Inner wall
40 Inner space

The invention claimed is:

1. A jet pump comprising a jet nozzle for accelerating a propellant, wherein the jet nozzle has a convergent inlet portion and an outlet portion which is connected to the convergent inlet portion, wherein the outlet portion comprises an inner space which is surrounded by an inner wall and which diverges at an opening angle, wherein the inner wall defines the opening angle relative to the narrowest cross section at an inlet opening of the inner space, wherein the opening angle is constructed in such a manner that a propellant which flows through the outlet portion at subsonic speed is released from the inner wall, wherein the outlet portion does not operate as a diffuser for the propellant which is flowing at subsonic speed therethrough and a propellant which flows through the outlet portion at supersonic speed is guided by the inner wall, wherein the opening angle is greater than 7°.

2. The jet pump as claimed in claim 1, wherein the inner wall of the outlet portion is constructed in such a manner that the propellant flowing through the outlet portion is released from the inner wall during a transition from supersonic speed to subsonic speed.

3. The jet pump as claimed in claim 1, wherein the inner wall of the outlet portion is constructed in such a manner that the propellant flowing through the outlet portion during a transition from subsonic speed to supersonic speed is positioned against the inner wall and is guided by the inner wall.

4. The jet pump as claimed in claim 1, wherein a pressure ratio of a propellant pressure of the propellant to a suction pressure after the outlet portion is between 1.05 and 5.

5. The jet pump as claimed in claim 1, wherein a pressure ratio of a propellant pressure of the propellant and a suction pressure after the outlet portion is between 1.1 and 2.5.

6. The jet pump as claimed in claim 1, wherein the opening angle is between 8° and 45°.

7. The jet pump as claimed in claim 1, wherein the inner wall of the outlet portion possesses a conical shape.

8. The jet pump as claimed in claim 1, wherein the inner wall of the outlet portion possesses a bell-like shape.

9. The jet pump as claimed in claim 1, wherein the jet nozzle lacks a constant diameter portion between the convergent inlet portion and the outlet portion.

* * * * *